US007122730B2

(12) United States Patent
Takegawa

(10) Patent No.: US 7,122,730 B2
(45) Date of Patent: Oct. 17, 2006

(54) BEATER WEIGHT ASSEMBLY FOR DRUM PEDAL

(75) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 57 days.

(21) Appl. No.: 10/826,376

(22) Filed: Apr. 19, 2004

(65) Prior Publication Data

US 2005/0155482 A1 Jul. 21, 2005

Related U.S. Application Data

(60) Provisional application No. 60/536,713, filed on Jan. 16, 2004.

(51) Int. Cl.
*G10D 13/02* (2006.01)

(52) U.S. Cl. ..... 84/422.1

(58) Field of Classification Search ..... 84/422.1, 84/422.2, 422.3, 422.4, 453
See application file for complete search history.

(56) References Cited

U.S. PATENT DOCUMENTS 1,343,164 A 6/1920 Smith
4,186,644 A 2/1980 Kurosaki
4,200,025 A * 4/1980 Currier ..... 84/422.1
4,691,612 A * 9/1987 Smith ..... 84/422.1
5,932,824 A 8/1999 Liao
5,998,718 A * 12/1999 Liao ..... 84/422.1
6,028,259 A 2/2000 Lombardi et al.

OTHER PUBLICATIONS

"Sonor, circa 1970s" (Photograph).
"Tama, 1994 to current" (Graphic).
"Drum Workshop, current" (Graphic).
"Drum Workshop, early 90s" (Photograph).

* cited by examiner

*Primary Examiner*—Kimberly Lockett
(74) *Attorney, Agent, or Firm*—Berenato, White & Stavish

(57) ABSTRACT

A beater weight assembly for a drum pedal comprises an adjustable main weight member as well as add-on weights selectively affixed to the main weight member. The main weight member is carried by the beater shaft. By adjusting the position and amount of the weight, the distribution of weight acting on the rotary element is altered to affect the balance point of the stroke of the beater element as well as rotational forces influencing the character of the beater stroke. The add-on weights may be affixed to the main weight member without removing the main weight member from the beater shaft.

14 Claims, 4 Drawing Sheets

BEATER WEIGHT ASSEMBLY FOR DRUM PEDAL

CROSS-REFERENCE TO RELATED APPLICATION

This Application claims the benefit under 35 U.S.C. 119(e) of U.S. Provisional Application No. 60/536,713 filed Jan. 16, 2004 by Akito TAKEGAWA.

BACKGROUND OF THE INVENTION

1. Field of the Invention

The present invention relates to a pedal assembly used to strike a drum and, more particularly, to an accessory used on such a drum pedal assembly to adjust a weight characteristic of the pedal assembly.

2. Description of Prior Art

The prior art has provided a wide variety of drum pedal assemblies. Generally, these pedal assemblies comprise a frame element 1 clamped to a drum hoop, a rotary element 2 rotatably supported by the frame element 1, a pedal element 3 secured to the frame element 1 and connected to the rotary element 2 by a linkage element 4 and a cam element 5, a retraction assembly 6 secured to the rotary element 2 and a beater element 6 adjustably secured to the rotary element 2 by a beater mount 7 thereon. See FIG. 1. All these elements work together for the purpose of axially rotating the beater element in and out of a strike position whereby a drum head is actuated.

Due to the wide range of musical styles, techniques and personal needs, the prior art has provided means to adjust or redistribute the weight of the drum beater. However, these adjustments lack the versatility necessary during use.

One adjustment offered by the prior art is that of beater extension which adjusts the radial distance between the head of the beater element and the axis of the rotary element whereby the arc circumference of the beater stroke as well as the inertia and torque acting on the beater element is affected. This adjustment is provided by the beater mount and is accomplished by securing the beater element at different points along the length of the stem.

The problem with this adjustment is that by increasing beater extension, the increase in arc circumference, inertia and torque results in a loss of speed but an increase of power and swing due to added momentum. Likewise, by decreasing beater extension, the decrease in arc circumference, inertia and torque results in an increase of speed but a loss of power and swing due to reduced momentum. For these reasons, it is difficult to achieve a satisfying combination of speed, power and swing.

Another adjustment offered by the prior art is that of beater angle which adjusts the stroking distance or throw of the beater element. This adjustment is accomplished by adjusting either the position of the beater mount or the rest position of the rotary element by means of the retraction element.

The problem with this adjustment is that when the beater angle is adjusted to provide a longer stroke, the increased stroking distance results in an increased degree of resistance by the retraction element when the beater reaches strike position. This problem requires additional applied pressure to the pedal element in order to compensate.

Another adjustment offered by the prior art is that of the retraction element which comprises a biasing spring eccentrically secured to the rotary element. This adjustment is accomplished by adjusting the torque of the biasing spring whereby the attack and response of the beater element is affected.

The problem with this adjustment is that by increasing the torque of the biasing spring to acquire a quicker attack and response there is added resistance to the pedal element. This problem also requires additional applied pressure to the pedal element in order to compensate.

Numerous attempts have been made to provide beater weights affixed to the rotary element of the beater shaft to improve the power of the hit by adding mass/weight to the beater. However, these beater weights are limited because they lack adjustability in the amount of weight applied to the beater without a complete disassembly of the weight assembly.

Due to these inherent problems found in the prior art and in answer to the need for improvement, the present invention is now disclosed.

SUMMARY OF THE INVENTION

The principal object of the present invention is to provide means of adjustment whereby the attack and response of the beater element may be affected without adjusting the angle of the beater element or the torque of the biasing spring.

Another object of the present invention is to provide means of adjustment whereby a satisfying combination of speed, power and swing may be achieved.

It will further be an object of the present invention to provide means of adjustment whereby the downward torque of the pedal element and biasing spring on the rotary element may be equalized for the purpose of providing a full and even swing to the beater element.

In addition, it will be an object of the present invention to provide means of adjustment which will be adaptable to any drum pedal assembly.

In accordance with the present invention, means of adjustment comprise an adjustable main weight member as well as add-on weight selectively affixed to the main weight member. The main weight member is carried by a beater shaft. By adjusting the position and amount of the weight, the distribution of weight acting on the rotary element is altered to affect the balance point of the stroke of the beater element as well as rotational forces influencing the character of the beater stroke.

These and other benefits of the invention will be apparent in light of the following drawings and related detailed description.

DETAILED DESCRIPTION OF PREFERRED EMBODIMENT

Figure 1:
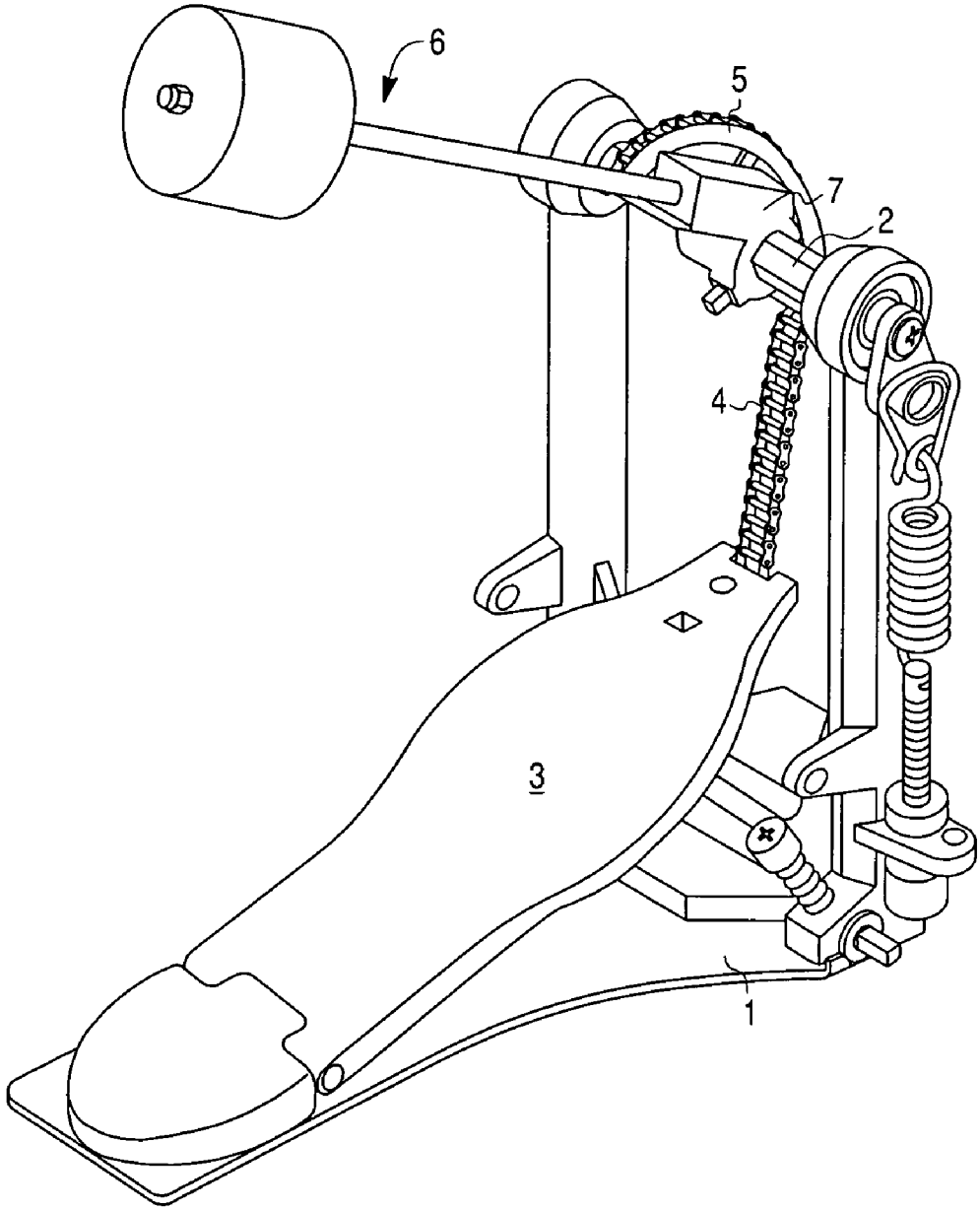
Fig. 1 Prior Art
FIG. 1 is a perspective view of a conventional drum pedal assembly.
Figure 2:
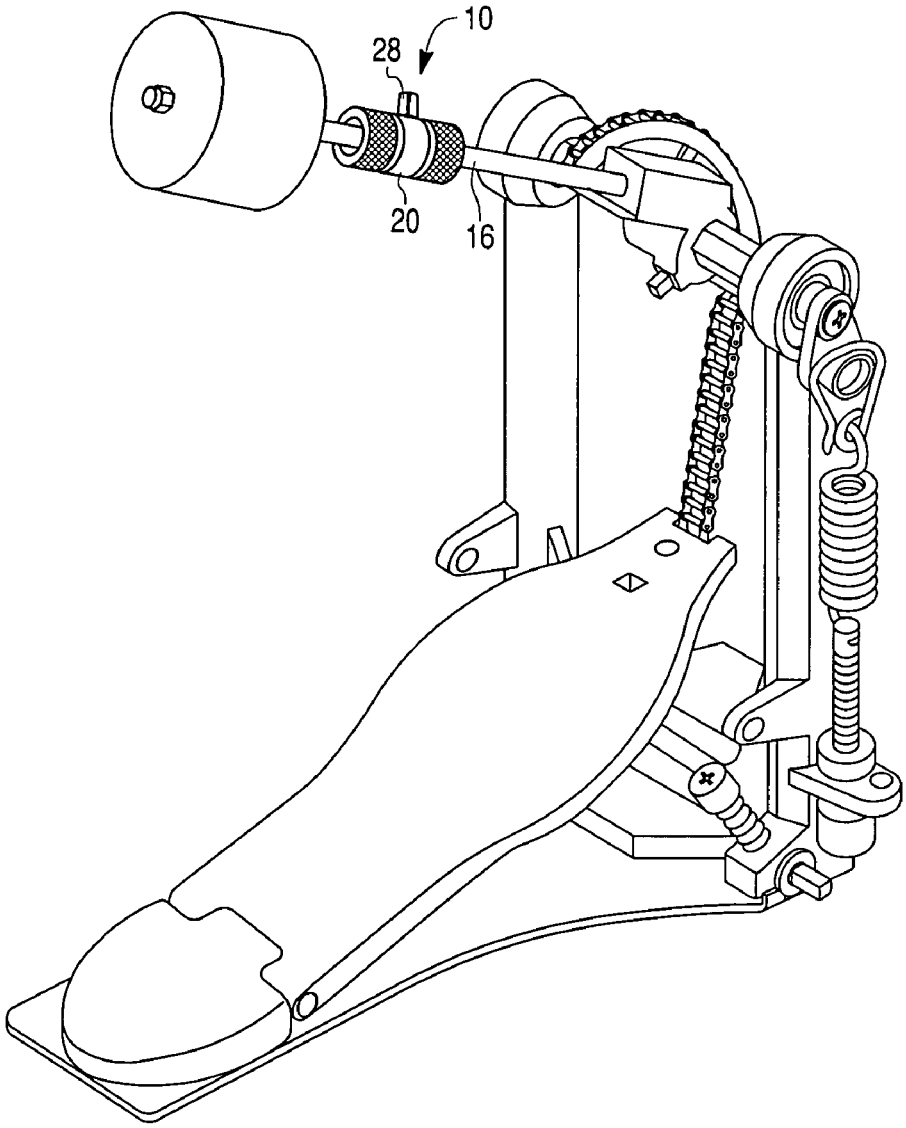
FIG. 2 is a perspective view of the present invention showing the preferred embodiment positioned on a beater shaft of a conventional drum pedal assembly.
Figure 3:
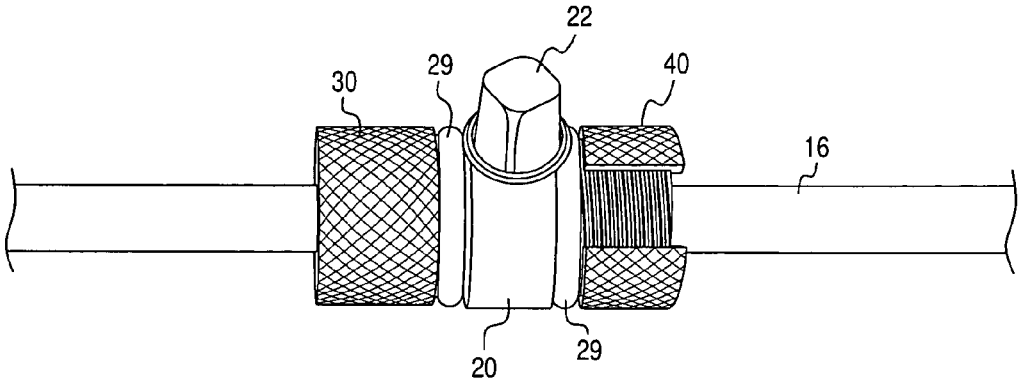
FIG. 3 is a close-up perspective view of the preferred embodiment of the invention on a beater shaft.

With reference to FIG. 2, the conventional drum pedal of FIG. 1 is shown with the beater weight assembly 10 of this invention. The beater weight assembly comprises a main weight member 20 having a set screw 28 threaded thereto in order that the main weight member 20 may be selectively positioned on the beater shaft 16. The set screw 28 is preferably formed as a key bolt adapted to be operated by a drummer's key used for other drum components. The main weight member 20 is an annular member with a central aperture receiving the beater shaft 16 whereby the set screw 28 is tightened against the beater shaft 16 to lock the main weight member 20 to the beater shaft 16. Add-on weight members 30, 40 are selectively positioned on the main weight member 20 to adjust the weight distribution of the beater weight assembly 10. In the preferred embodiment, the add-on weight members 30, 40 are threaded onto threaded mounting legs 24, 26 of the main weight member 20.

Figure 4:
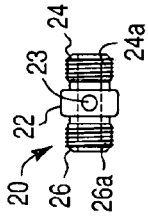
FIG. 4 is a front side view of the main weight member.
Figure 5:
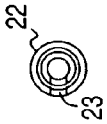
FIG. 5 is a right side view of the main weight member of FIG. 4.
Figure 6:
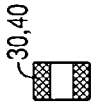
FIG. 6 is a front side view of an add-on weight member.
Figure 7:
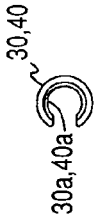
FIG. 7 is a right side view of the add-on weight member of FIG. 6.
Figure 8A:
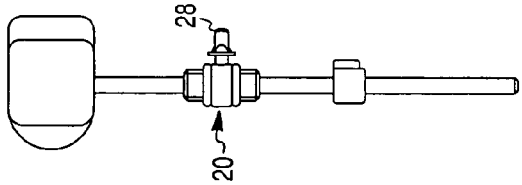
FIGS. 8A–8G illustrate a variety of weight distribution arrangements according to the present invention.
Figure 8B:
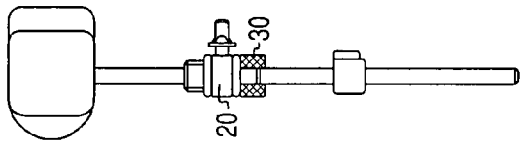
Figure 8C:
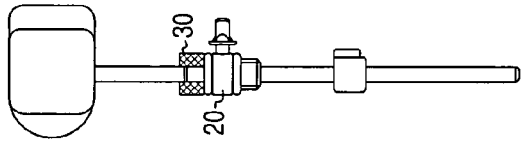
Figure 8D:
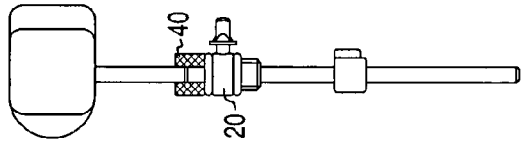
Figure 8E:
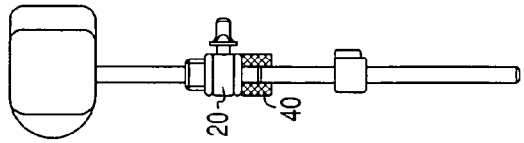
Figure 8F:
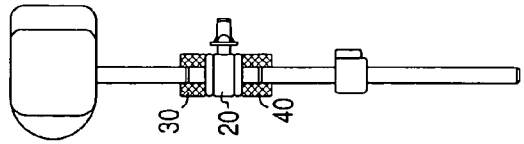
Figure 8G:
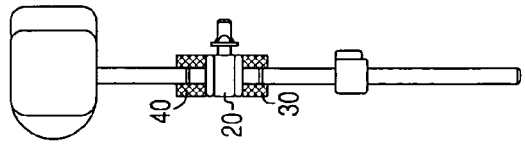

With reference to FIGS. 4 and 5, the main weight member 20 includes a central mounting portion 22 having a threaded aperture 23 through which the set screw 28 is disposed. Add-on legs 24, 26 are disposed on opposite sides of the central mounting portion 22 wherein the add-on weights 30, 40 are fixedly received on the add-on legs 24, 26—preferably through a threaded connection. Specifically, threaded portions 24*a*, 26*a* are provided on the add-on legs 24, 26, and matching threaded portions 30*a*, 40*a* are provided on the add-on weights 30, 40. As shown in FIGS. 6 and 7, the add-on weights 30, 40 are formed as a c-shaped member so that the add-on weights 30, 40 can be added to the main weight member 20 without disassembling the beater shaft 16 from the shaft mount (see element 7 of FIG. 1). Resilient (e.g., rubber) o-rings 29 are disposed or sandwiched between the main weight member 20 and each add-on weight 30, 40 to keep the add-on weights 30, 40 securely fastened to the main weight member 20, because the o-ring 29 prevents vibration between the main weight member 20 and the add-on weights 30, 40.

The main weight member 20 may be made of any suitable material but it is preferably made of aluminum and weighs about 10.4 grams. The add-on weights 30, 40 may be made of any suitable material but they are preferably made of brass or steel and preferably weigh about 5–8 grams depending on the specifications of the drum pedal as would be understood by those of skill in the art.

FIGS. 8A–8G shows a variety of different weight distribution arrangements using the main weight member 20 and the add-on weights 30, 40. Of course, the number and design of the add-on weight should not be limited to the preferred embodiment shown and described herein because any number and arrangement of add-on weights may be employed in accordance with the spirit and scope of the present invention.

While the foregoing invention has been shown and described with reference to the preferred embodiment, various changes in form and detail may be made therein without departing from the spirit and scope of the present invention.

The invention claimed is:

1. An assembly for adjusting torque of a drum beater device including a foot-operated pedal drivingly connected to a rotating shaft and a beater mounted to said rotating shaft via a beater shaft, comprising an adjustable main weight member adapted to be selectively mounted to said beater shaft; and at least one add-on weight adapted to be selectively affixed to said main weight member, wherein said at least one add-on weight is formed to partially circumscribe said beater shaft such that said at least one add-on weight may be added to said main weight member without removing said beater shaft from said rotating shaft.

2. The assembly of claim 1, wherein said main weight member is a cylindrical member that circumscribes said beater shaft.

3. The assembly of claim 1, wherein said main weight member comprises mechanical fastening means for selectively affixing said main weight member to discrete positions along a length of said beater shaft.

4. The assembly of claim 3, wherein said mechanical fastening means comprises a key bolt adapted to be operated by a drummer's key used for other drum components.

5. The assembly of claim 1, wherein said at least one add-on weight is fitted onto a mounting leg of said main weight member.

6. The assembly of claim 1, wherein said at least one add-on weight is slidingly disposed on a mounting leg of said main weight member.

7. The assembly of claim 1, wherein said at least one add-on weight is threadingly disposed on a mounting leg of said main weight member.

8. The assembly of claim 1, further comprising a resilient member interposed between said main weight member and said at least one add-on weight to prevent vibration therebetween.

9. The assembly of claim 1, wherein said at least one add-on weight is c-shaped.

10. The assembly of claim 1, wherein said main weight member comprises a pair of mounting legs to selectively mount at least two add-on weights to said main weight member.

11. The assembly of claim 1, wherein said assembly provides at least three weight arrangements that may be positioned at substantially any position along a length of said beater shaft.

12. The assembly of claim 11, wherein said at least three weight arrangements comprises a first arrangement where said main weight member is disposed on said beater shaft without an add-on weight, a second arrangement where a single add-on weight is affixed to said main weight member, and a third arrangement where two add-on weights are affixed to said main weight member.

13. An assembly for adjusting torque of a drum beater device including a foot-operated pedal drivingly connected to a rotating shaft and a beater mounted to said rotating shaft via a beater shaft, comprising:

an adjustable main weight member adapted to be selectively mounted to said beater shaft;

at least one add-on weight adapted to be selectively affixed to said main weight member, wherein said at least one add-on weight is formed to partially circumscribe said beater shaft such that said at least one add-on weight may be added to said main weight member without removing said beater shaft from said rotating shaft; and a resilient member interposed between said main weight member and said at least one add-on weight to prevent vibration therebetween.

14. An assembly for adjusting torque of a drum beater device including a foot-operated pedal drivingly connected to a rotating shaft and a beater mounted to said rotating shaft via a beater shaft, comprising:

an adjustable main weight member adapted to be selectively mounted to said beater shaft; and at least one c-shaped add-on weight adapted to be selectively affixed to said main weight member, wherein said at least one add-on weight is formed to partially circumscribe said beater shaft such that said at least one add-on weight may be added to said main weight member without removing said beater shaft from said rotating shaft.

* * * * *